US006360658B1

(12) United States Patent
Benson

(10) Patent No.: US 6,360,658 B1
(45) Date of Patent: Mar. 26, 2002

(54) ROLLER STAMP HAVING INTERCHANGEABLE SYMBOLS

(75) Inventor: J. Terry Benson, West Hills, CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/364,895

(22) Filed: Aug. 2, 1999

(51) Int. Cl.[7] ..... B41J 1/22; B41F 17/00

(52) U.S. Cl. ..... 101/109; 101/328; 101/373; 101/405; 101/368

(58) Field of Search ..... 101/84, 85, 86, 101/87, 103, 106, 108, 109, 110, 327, 328, 333, 371, 372, 373, 374, 375, 368, 405

(56) References Cited

U.S. PATENT DOCUMENTS

| | | | | | |
|---|---|---|---|---|---|
| 640,449 | A | | 1/1900 | Cressler | 101/108 |
| 1,092,749 | A | | 4/1914 | Ryan | 101/329 |
| 1,298,918 | A | | 4/1919 | Enck | 101/333 |
| 1,447,753 | A | * | 3/1923 | Bowes | 101/86 |
| 1,905,526 | A | * | 4/1933 | Swanson | 101/91 |
| 3,453,952 | A | * | 7/1969 | Huber | 101/110 |
| 3,537,394 | A | | 11/1970 | Swapp | 101/328 |
| 5,303,648 | A | | 4/1994 | Shih | 101/327 |
| 5,410,962 | A | | 5/1995 | Collier | 101/375 |
| 5,435,245 | A | | 7/1995 | Salisbury et al. | 101/405 |
| 5,505,133 | A | * | 4/1996 | Chen | 101/368 |
| 5,524,536 | A | * | 6/1996 | Moizeau | 101/110 |
| 5,586,500 | A | | 12/1996 | Takami et al. | 101/327 |
| 5,732,627 | A | | 3/1998 | Imamaki | 101/328 |

* cited by examiner

*Primary Examiner*—Leslie J. Grohusky
(74) *Attorney, Agent, or Firm*—Roy A. Ekstrand

(57) ABSTRACT

A stamp playset includes a book-like case supporting a plurality of symbol pads together with an elongated inking pad and a generally cylindrical roller stamp. The roller stamp includes a cylindrical housing within which a cylindrical roller is supported. The cylindrical roller defines a plurality of attachment slots which receive attachment flanges of selected symbol pads. The symbol pads are arrangeable in a variety of sequences as desired. The roller further supports a symbol cube having a plurality of symbol elements. The symbol cube is rotatably supported to facilitate alignment of a selected one of the plurality of symbol elements thereon within the sequence of symbols to be roller stamp.

4 Claims, 2 Drawing Sheets

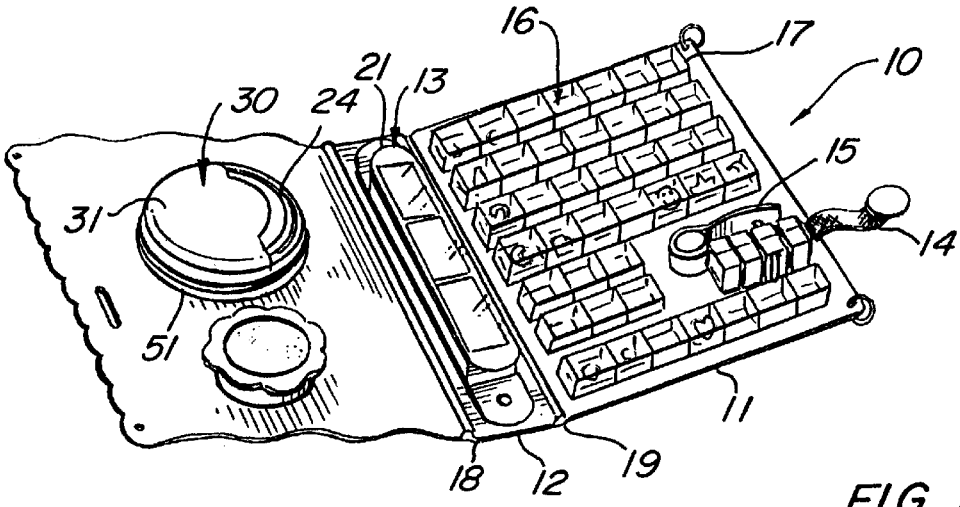
FIG. 1
FIG. 3
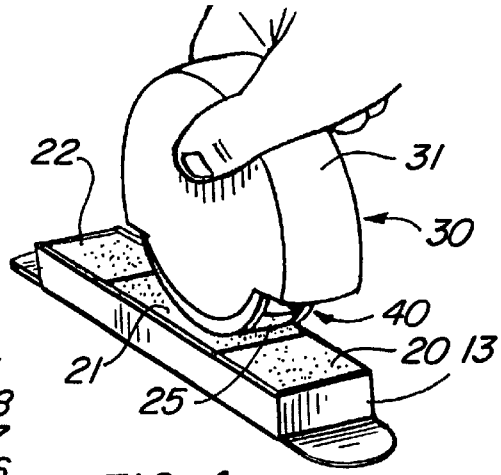
FIG. 2
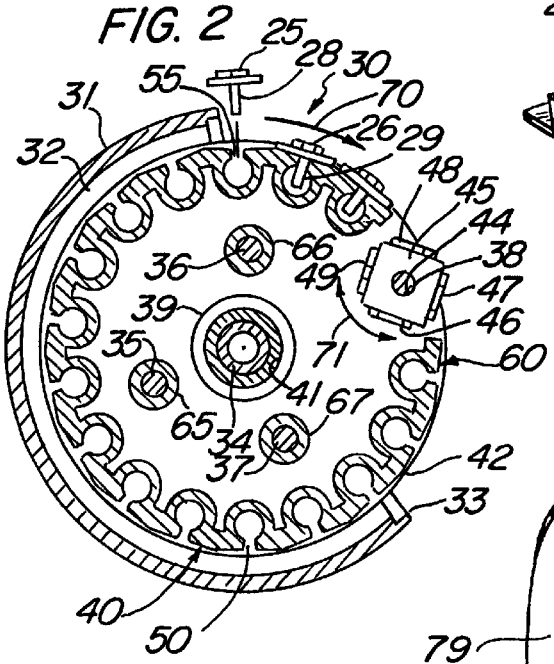
FIG. 4
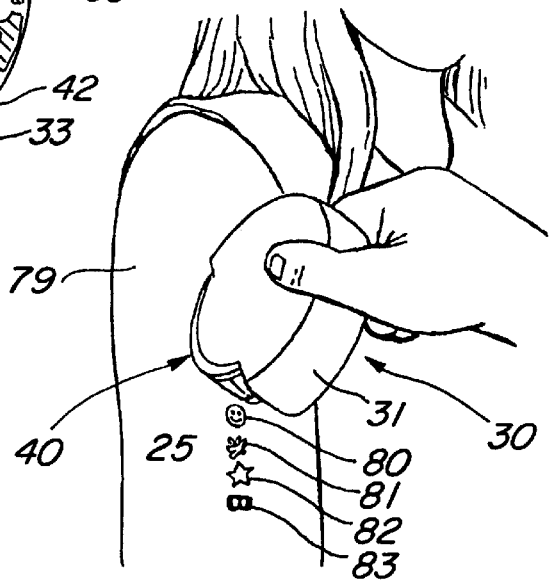

ROLLER STAMP HAVING INTERCHANGEABLE SYMBOLS

FIELD OF THE INVENTION

This invention relates generally to stamps and particularly to those which are used to provide a plurality of ink or embossed symbols in a straight line arrangement upon a medium such as paper or the like.

BACKGROUND OF THE INVENTION

Stamps and other embossing devices are extremely well known in the art and exist in a virtually endless variety of shapes, styles and functions. While subject to substantial variation, the basic function of a stamp is to transfer a quantity of ink residing upon an inked symbol embossment or pad to a medium such as paper, cloth or the like. Stamps have been provided which are used in a brood area of human activity and have included use in commerce, play or amusement and the arts. When used in commerce stamps are convenient means for providing a commercially important image such as a date or address or other repeatedly utilized information upon a document thereby avoiding repetitive and tiresome writing or printing thereof. In commerce, stamps find particular use in authenticating a document. Often the legal authenticity of a document resides in its having a particular government agency or authenticating agent stamp embossed thereon.

When utilized in toy or play activities, stamps have been provided in a variety of configurations which contribute to the exercise and development of a child's recognition and skill of shapes, color and sizes. Also stamps have been provided which require spelling activities further enhancing child development.

In the field of art and other decorative and creative activities, stamps have been provided which are used for serious artistic work often upon expensive and exotic media. Additionally, stamps have been provided for so-called "stenciling" activities upon wall surfaces. Still other stamps are used in providing a decorative trim such as a border or the like.

Perhaps one of the most pervasive types of stamps finding particular use in the toy or play activities or in the artistic activities described above is generally described as a "roller stamp". While roller stamps have been fabricated using a variety of different structures, all generally include a rotatable roller, wheel or drum having an outer surface. The outer surface supports a plurality of raised symbols which may for example may include alphabet letters, numbers or other artistic icons such as hearts, diamonds, crosses and so on. A method of inking the embossing members of the stamp may include a simple stamp pad across which the roller is drawn or more complex so-called "automatic inkers" which brush or feed ink to the embossing surfaces of the stamp. One such roller stamp presently available in the art for use by children in various play patterns is manufactured by Rose Art Industries Inc. under the name "stamp doodler" which provides a generally cylindrical hand-held housing defining a hollow interior and supporting a rotatable stamp roller. The housing is open at one side to expose the outer surface of the stamp roller. A plurality of embossing elements having various symbols formed thereon are supported on the outer surface of the roller. A self inking mechanism is supported within the housing and operates to transfer ink to the embossing surfaces of the roller. In use, the child grips the housing and simply rolls the stamp roller across a medium such as paper or the like.

U.S. Pat. No. 5,435,245 issued to Salisbury et al. sets forth a SELF-INKING ROLLER STAMP which includes a wheel having a raised printing surface and a housing supporting the wheel. The housing is configured to hold a porous point marker having its nib positioned to continuously ink the printing surface as the roller rotates.

U.S. Pat. No. 3,537,394 issued to Swapp sets forth a PRINTING WHEEL FOR PRINTING LAYOUT MARKS having a plurality of marking pads supported upon the periphery of a cylindrical wheel which may be selectively raised into the wheel during alternate revolutions of the wheel. Opposed marking pads of a second type are individually manually positioned into and out of the exposed location to accommodate predetermined spacing of the marks.

U.S. Pat. No. 1,298,918 issued to Enck sets forth a TOY PRINTING WHEEL having a housing supporting a rotating drum defining an outer cylindrical surface. The interior surfaces of the drum support visible indicia corresponding to the embossing pad on the outer surface of the drum.

U.S. Pat. No. 5,303,648 issued to Shih sets forth a ROLLER STAMP having a housing shaped to generally resemble a toy vehicle within which a frontal roller is rotatably supported. A plurality of rear wheels are supported at the rear of the housing. A rotatable inking pad is rotatable within the housing and is proximate to the frontal roller. The frontal roller defines various embossing pads and a quantity of ink is transferred thereto by the rotating ink roller.

U.S. Pat. No. 5,410,962 issued to Collier sets forth a SPECIAL EFFECTS ROTATING RUBBER STAMP having a rotatable drum supporting a plurality of embossing thereon and a handle for manipulating the roller. The handle supports a sound effects generator which produces sounds as the stamp is rolled across a printing surface.

U.S. Pat. No. 5,732,627 issued to Imamaki sets forth a CYLINDRICAL STAMP having a ring-like member and an ink impregnated body provided about the outer periphery of the ring-like member. A perforated stencil is supported about the outer periphery of the ink impregnated body. The stencil defines a desired pattern permitting ink to flow outwardly through the stencil openings for transfer to a printing medium such as paper or the like.

U.S. Pat. No. 1,092,749 issued to Ryan sets forth a SIGN PRINTER for use in road way printing having a wheel supporting a plurality of embossing pads on the periphery thereof. A paint roller is rolled against the outer periphery of the wheel transferring paint to the pads. As the supporting vehicle moves the wheel is rotated upon the underlying road surface transferring a printed image thereto.

U.S. Pat. No. 5,586,500 issued to Takami et al. sets forth a STENCIL STAMP while U.S. Pat. No. 640,449 issued to Cressler sets forth a STAMP WITH CHANGEABLE FACE both of which are illustrative of commercially used stamps.

While the forgoing described prior art devices have to some extent improved the art and have in some instances enjoyed commercial success, there remains nonetheless a continuing need in the art for ever more improved interesting and easy to use stamp devices.

SUMMARY OF THE INVENTION

Accordingly, it is a general object of the present invention to provided an improved roller type stamp. It is a more particular object of the present invention to provide an improved roller type stamp which facilitates the interchangeability of stamped symbols in a simple and effective manner.

In accordance with the present invention there is provided a roller stamp comprising: a generally cylindrical housing having an open side defining an edge; a roller rotatably supported within the housing such that a portion of the roller is exposed beyond the edge, the roller having an arcuate fence; a plurality of symbol pads each having means for attachment to the fence; and a multi-faceted element rotatably supported by the roller having a plurality of symbol elements each selectively positionable in arcuate alignment with the symbol pads by rotation of the multi-faceted element.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 sets forth a perspective view of a roller stamp and associated apparatus constructed in accordance with the present invention;

FIG. 2 sets forth a section view of the roller stamp of the present invention;

FIG. 3 sets forth a perspective view of the inking process of the present invention roller stamp;

FIG. 4 sets forth a partial perspective view of the present invention roller stamp in a body stamping activity;

DESCRIPTION OF THE PREFERRED EMBODIMENT

Figure 5:
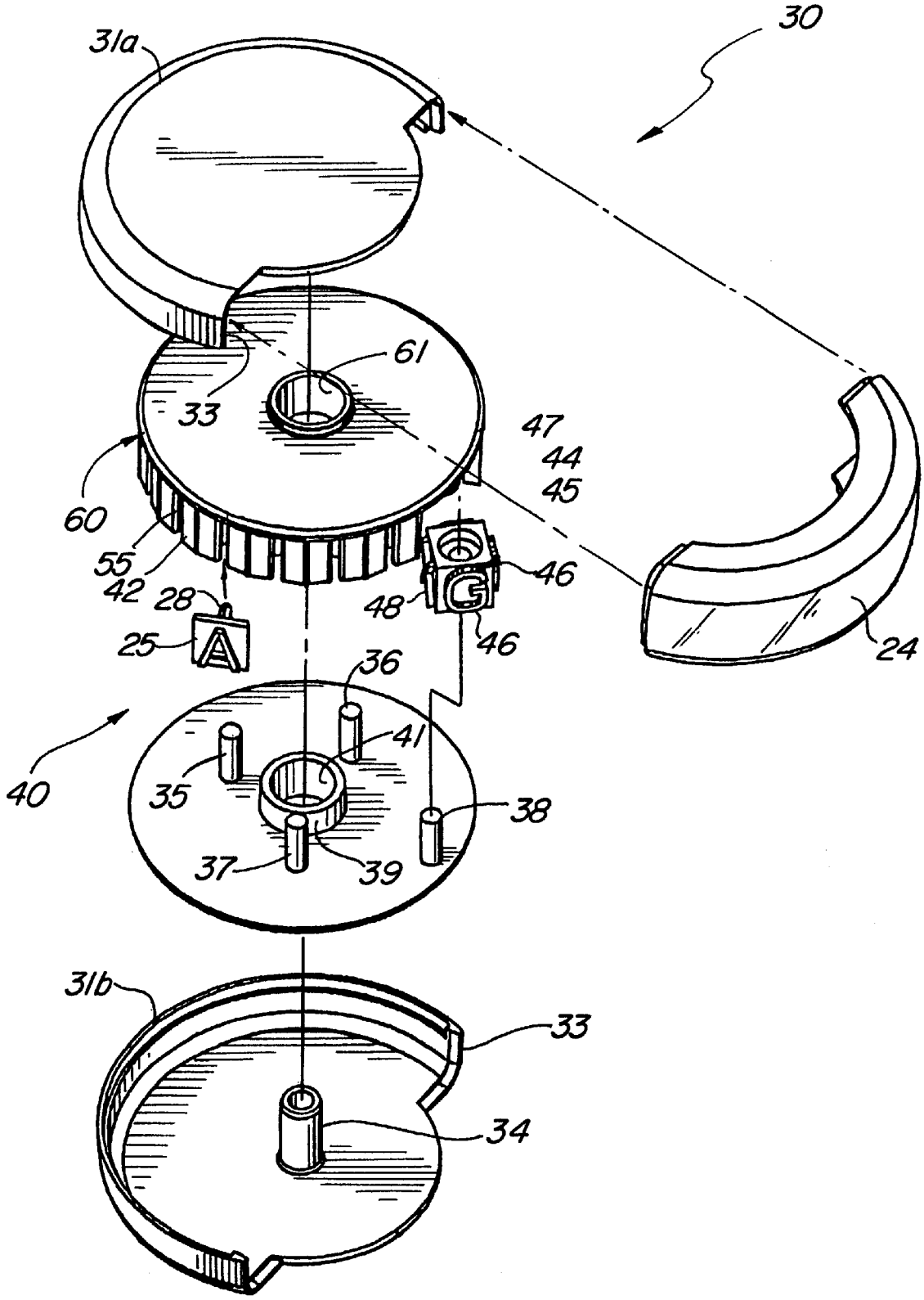
FIG. 5 sets forth a perspective assembly view of the present invention roller stamp.

FIG. 1 sets forth a stamp playset constructed in accordance with the present invention and generally referenced by numeral 10. Stamp playset 10 includes a book-like case 11 having a spine 12 and a pair of hinges 18 and 19. Spine 12 supports an elongated multiply segment ink pad 13 having a protective cover 21 received thereon. Case 11 further supports a plurality of symbol pads 16 fabricated in the manner set forth below which are generally received within case 11 in a linear row arrangement. Plurality of symbol pads 16 for each row are covered by a plurality of protective covers 17. Case 11 further supports a pair of tongs 15 and a resilient clasp 14.

Case 11 further includes a receptacle 51 within which a roller stamp 30 is received. Roller stamp 30 is fabricated in the manner set forth below in greater detail and includes a generally cylindrical housing 31 supporting a cylindrical portion cap 24.

FIG. 2 sets forth a section view of roller stamp 30 having cap 24 removed. Roller stamp 30 includes a housing 31 defining an edge 33 and having a center post 34. As is better seen in FIG. 5, housing 31 is formed of a pair of mirror image half segments 31*a* and 31*b* joined to form the completed structure of housing 31. Within housing 31, a generally cylindrical roller 40 which as is better seen in FIG. 5 is formed of a roller plate 50 and a roller drum 60 is rotatably supported upon post 34. Roller plate 50 includes a generally cylindrical collar 39 having a bore 41 formed therein. Roller plate 50 further includes a plurality of upwardly extending posts 35, 36 and 37. Roller plate 50 further includes an upwardly extending post 38 positioned near the outer periphery of roller plate 50. Roller drum 60 includes a generally arcuate fence 42 having a plurality of slots 55 formed therein. Roller drum 60 further defines a plurality of downwardly extending cylindrical bosses 65, 66 and 67 together with a center boss 61. Roller drum 60 is joined to roller plate 50 by the insertion of boss 61 within bore 41 of collar 39 and the insertion of posts 35, 36 and 37 of roller plate 50 within bosses 65, 66 and 67. Thus, roller drum 60 and roller plate 50 are joined to form a generally cylindrical structure generally referenced by numeral 40 which is rotatably supported within housing 31 upon post 34 of housing segment 31*b* (seen in FIG. 5). The attachment of roller plate 50 and roller drum 60 may be further strengthened by the use of attachment between posts 35 through 37 and bosses 65 through 67 as well as boss 61 and collar 39 using attachment means such as thermal welding or adhesive or the like.

In accordance with the present a symbol cube 45 defining an aperture 44 therein is rotatable supported upon post 38 of roller plate 50. In further accordance with the present invention, symbol cube 45 supports a plurality of symbol elements 46, 47, 48 and 49 on respective sides of the symbol cube. Symbol cube 45 is rotatable upon post 38 in either direction as indicated by arrows 71. This rotatable support of symbol cube 45 permits each of symbol elements 46 through 49 to be selectively positioned in an outwardly facing alignment. In this manner, a selected one of the plurality of symbol elements supported upon cube 45 may be position to perform the stamping action described below.

In further accordance with the present invention, a plurality of symbol pads such as pads 25, 26 and 27 are attachable to fence 42 in the desired stamping order. The attachment of the desired arrangement of symbol pads upon fence 42 is achieved by inserting the support flange of each selected symbol pad into the selected one of slots 55 formed in fence 42. Thus for example, symbol pad 25 includes a flange 28 which may be inserted into slot 55 of fence 42 to assemble symbol pad 25 thereto. By way of further illustration, symbol pad 26 having flange 29 is shown assembled to fence 42. Thus the user prepares roller stamp 30 for the stamping activity described below by initially positioning cube 45 to align the desired one of symbols 46 through 49 and by inserting the selected ones of symbol pads 16 (seen in FIG. 1) into fence 42 in the desired arrangement and relationship.

It will be noted that symbol cube 45 is illustrative of a number of multi-faceted elements which may be rotatably supported on roller 40 and is not limiting. Thus, other multi-faceted elements such as three, five or more facet elements may be used. The essential aspect of the multi-faceted element is its function of rotating a selected symbol element into arcuate (circle diameter) alignment with the remaining symbol pads on roller 40.

FIG. 3 shows a perspective view of the present invention roller stamp in the process of inking the symbol pads which have been previously assembled to roller 40 in the manner described above. Thus roller stamp 30 which includes housing 31 and which rotatably supports roller 40 is positioned above ink pad 13 as shown. Ink pad 13 defines a plurality of ink supply segments 20, 21 and 22 which may for example include different colors of stamping ink. The fabrication of ink supplies 20, 21 and 22 may be entirely conventional and may for example utilize open foam segments suitable for retaining a quantity of stamping ink. Roller 40 supports a plurality of symbol pads such as symbol pad 25 assembled in the manner described above. The inking process is carried forward by holding roller stamp 30 above ink pad 13 in the manner shown such that roller 40 is brought into contact with ink supplies 20, 21 and 22 and ink is transferred to the various symbol pads supported thereon by simply rolling the roller stamp across one or more of the ink supply segments. Once a quantity of stamping ink has been transferred to the various symbol pads upon roller 40, roller stamp 30 is ready for stamping activity. While roller stamp 30 may be utilized in embossing or inking a stamp pattern upon a medium such as paper or the like by simply rolling roller 40 across the medium, additional interest is provided by using roller stamp 30 as a "body art" play device. In this activity roller stamp 30 is rolled upon a portion of the users skin in the manner shown in FIG. 4. Preferably of coarse, the use of roller stamp 30 in this body art stamping anticipates the use of washable inks within ink pad 13.

FIG. 4 sets forth a partial perspective view of the body art stamping activity utilizing roller stamp 30 upon an arm 79 of a typical child user. As described above, roller stamp 30 includes a housing 31 rotatably supporting a roller 40 having a plurality of outwardly facing symbol pads such as symbol pad 25. With roller 40 having been inked in the manner described above in FIG. 3 or using other conventional ink transfer processes, the user simply rolls roller 40 upon arm 79 causing a plurality of symbols such as symbols 80, 81, 82 and 83 to be imprinted or inked upon arm 79. As mentioned above, the ink utilized in such body art activities is preferably washable allowing the variously printed symbols to be easily removed with soap and water.

FIG. 5 sets forth a perspective assembly view of roller stamp 30. Roller stamp 30 includes a pair of housing half segments 31*a* and 31*b* which are generally mirror image segments combined to form housing 31. Housing segments 31*a* and 31*b* define a combined edge 33 when assembled to form housing 31. Housing half segment 31*b* includes an upwardly extending center post 34. Half segments 31*a* and 31*b* may be joined using conventional attachment such as adhesive material or other assembly processes such as thermal or sonic welding as desired. Roller stamp 30 includes a roller plate 50 having a plurality of upwardly extending posts 35, 36 and 37 together with a cylindrical collar 39. Collar 39 in turn defines an internal bore 41. An additional post 38 extends upwardly from roller plate 50 and is positioned near the outer edge thereof. A symbol cube 45 having a generally cube-like body defines an aperture 44 and supports a plurality of symbol elements 46, 47, 48 and 49. Symbol cube 45 is rotatably supported upon post 38 by inserting post 38 into aperture 44.

A roller drum 60 includes an arcuate fence 42 having a plurality of slots 55 formed therein. Roller drum 60 further includes a downwardly extending cylindrical boss 61 which is received within bore 41 of collar 39. As is better seen in FIG. 2, roller drum 60 further defines a plurality of cylindrical bosses 65, 66 and 67 extending downwardly to receive posts 35, 36 and 37 of roller plate 50 and roller drum 60 are assembled together to form roller 40 (seen in FIG. 3). When thus assembled, the combined structure of roller plate 50 and roller drum 60 which comprises roller 40 is rotatably supported upon post 34 within the interior of housing half segments 31a and 31*b*. Edge 33 of roller stamp 30 provides exposure of a portion of roller 40 to facilitate the roller stamp process.

Once the combined structures of housing segments 31*a* and 31*b* together with roller plate 50 and roller drum 60 and symbol cube 45 have assembled, a selected group of symbol pads is assembled to fence 42 of roller drum 40 in the manner described above. For purposes of illustration, symbol pad 25 having flange 28 is shown in position 4 assembly to fence 42. In addition and with an important aspect of the present invention, symbol cube 45 is rotated about post 38 to position the selected one of symbol elements 46 through 49 in the outwardly facing alignment which will result in stamping the selected symbol element during the roller stamping process. Upon completion of the stamping activities, cover plate 24 is snap-fit attached to housing 31 allowing roller stamp 30 to be handled and carried despite the continued presence of residual ink upon the various symbol pads of roller 40.

What has been shown is a novel roller stamp having a structure which is easily used by young children and which facilitates interchangeable symbols in an easy and convenient manner. The interchangeable symbols utilize a plurality of separately attached symbol pads together with a rotatable symbol cube having a number selectively alignable symbol elements thereon. The operation of the roller stamp is extremely straight forward in its use while the arrangement of interchangeable symbol pads upon the roller facilitates and enhances the teaching of spelling skills.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A roller stamp comprising:

a generally cylindrical housing having an open side defining an edge;

a roller rotatably supported within said housing such that a portion of said roller is exposed beyond said edge, said roller having an arcuate fence;

a plurality of interchangeable symbol pads each having means for removable attachment to said fence; and a multi-faceted element rotatably supported by said roller having a plurality of symbol elements each selectively positionable in arcuate alignment with said symbol pads by rotation of said multi-faceted element.

2. The roller stamp set forth in claim 1 wherein said arcuate fence defines a plurality of female openings and wherein said means for attachment to said fence include male members insertable into said female openings.

3. The roller stamp set forth in claim 2 wherein said multi-faceted element is a cube.

4. The roller stamp set forth in claim 3 wherein said female openings are slots and wherein said male members are flanges.

* * * * *